US011486212B1

(12) United States Patent
Jamison et al.

(10) Patent No.: US 11,486,212 B1
(45) Date of Patent: Nov. 1, 2022

(54) DETERMINING A LAMINAR-TURBULENT TRANSITION REGION FOR A WELLBORE FLUID

(71) Applicant: Halliburton Energy Services, Inc., Houston, TX (US)

(72) Inventors: Dale E. Jamison, Humble, TX (US); Andrew Vos, Spring, TX (US)

(73) Assignee: HALIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 17/566,955

(22) Filed: Dec. 31, 2021

(51) Int. Cl.

| | |
|---|---|
| ***E21B 21/08*** | (2006.01) |
| ***E21B 47/10*** | (2012.01) |
| ***E21B 47/07*** | (2012.01) |
| ***E21B 36/00*** | (2006.01) |
| ***E21B 43/26*** | (2006.01) |

(52) U.S. Cl.
CPC ..... *E21B 21/08* (2013.01); *E21B 36/006* (2013.01); *E21B 43/2607* (2020.05); *E21B 47/07* (2020.05); *E21B 47/10* (2013.01); *E21B 2200/20* (2020.05)

(58) Field of Classification Search
CPC ..... E21B 21/08; E21B 47/10
See application file for complete search history.

(56) References Cited

U.S. PATENT DOCUMENTS

| | | | | |
|---|---|---|---|---|
| 4,435,978 | A * | 3/1984 | Glatz | E21B 47/103 73/152.52 |
| 5,741,979 | A * | 4/1998 | Arndt | G01F 1/74 73/861.05 |
| 6,931,952 | B2 * | 8/2005 | Rantala | G01M 3/005 73/431 |
| 8,291,975 | B2 * | 10/2012 | Roddy | E21B 33/13 166/250.1 |
| 9,091,133 | B2 * | 7/2015 | Stewart | E21B 23/00 |
| 10,653,027 | B2 * | 5/2020 | van Pol | G01F 1/684 |
| 10,704,383 | B2 * | 7/2020 | Andreychuk | E21B 33/14 |
| 10,927,673 | B2 * | 2/2021 | Bouldin | G01F 1/84 |
| 2003/0029640 | A1 | 2/2003 | Cooper | |
| 2011/0266056 | A1 * | 11/2011 | Pop | G05B 13/048 703/7 |
| 2021/0215035 | A1 * | 7/2021 | Granville | E21B 47/10 |

FOREIGN PATENT DOCUMENTS

| | | |
|---|---|---|
| CN | 102538913 | 6/2014 |

* cited by examiner

*Primary Examiner* — Kenneth L Thompson
(74) *Attorney, Agent, or Firm* — Kilpatrick Townsend & Stockton LLP

(57) ABSTRACT

Apparatus and methods for determining a laminar-turbulent transition of a fluid are provided. For example, a measurement tool can receive a set of wellbore conditions received from a wellbore. Measurement tool parameters can be determined based on the set of wellbore conditions. The measurement tool can be set according to the measurement tool parameters such that a fluid received from the wellbore can move through the measurement tool in a laminar state. The measurement tool may be adjusted according to the measurement tool parameters such that the fluid moves in a turbulent state. The measurement tool may determine a laminar-turbulent transition region for the fluid. The measurement tool may output the laminar-turbulent transition region for use in a drilling operation in the wellbore.

8 Claims, 5 Drawing Sheets

DETERMINING A LAMINAR-TURBULENT TRANSITION REGION FOR A WELLBORE FLUID

TECHNICAL FIELD

The present disclosure relates generally to wellbore drilling operations and, more particularly (although not necessarily exclusively), to determining a laminar-turbulent transition region of a fluid used in drilling operations in a wellbore.

BACKGROUND

A wellbore can be drilled into a subterranean formation for extracting produced hydrocarbon material. One or more wellbore operations can be performed with respect to the wellbore. Examples of wellbore operations can include a drilling operation, a stimulation operation, a production operation, other suitable wellbore operations, or any combination thereof. Drilling operations may involve drilling fluid, (e.g., drilling mud) that may flow downhole through the wellbore. The state of the drilling fluid may affect drilling operations. For example, an increased amount of drilling fluid may directly or indirectly change wellbore conditions such as wellbore pressure, temperature, flowing rate of fluid, density of fluid, and viscosity of fluid.

The drilling fluid may be in a laminar state or a turbulent state. A laminar state can occur when a fluid flows in parallel layers, with no disruption between the layers. At low velocities, there may be no crosscurrents perpendicular to the direction of flow, nor eddies or swirls of fluids. Drilling fluid in a turbulent state can include rapid variation of pressure and flow velocity. In contrast to laminar state, the drilling fluid may not travel in layers. When the flow pressure or velocity of the drilling fluid increases, the laminar state can gradually transition to the turbulent state. The process of flow in laminar state transitioning to turbulent state is known as a laminar-turbulent transition. The main parameter characterizing transition is the Reynolds number. While the drilling fluid is in the laminar-turbulent transition region, the wellbore pressure can be hard to manage due to constant changes in flow rate, viscosity, and density of the drilling fluid. Drilling operations can be affected due to failures in managing wellbore pressure.

DETAILED DESCRIPTION

Figure 1:
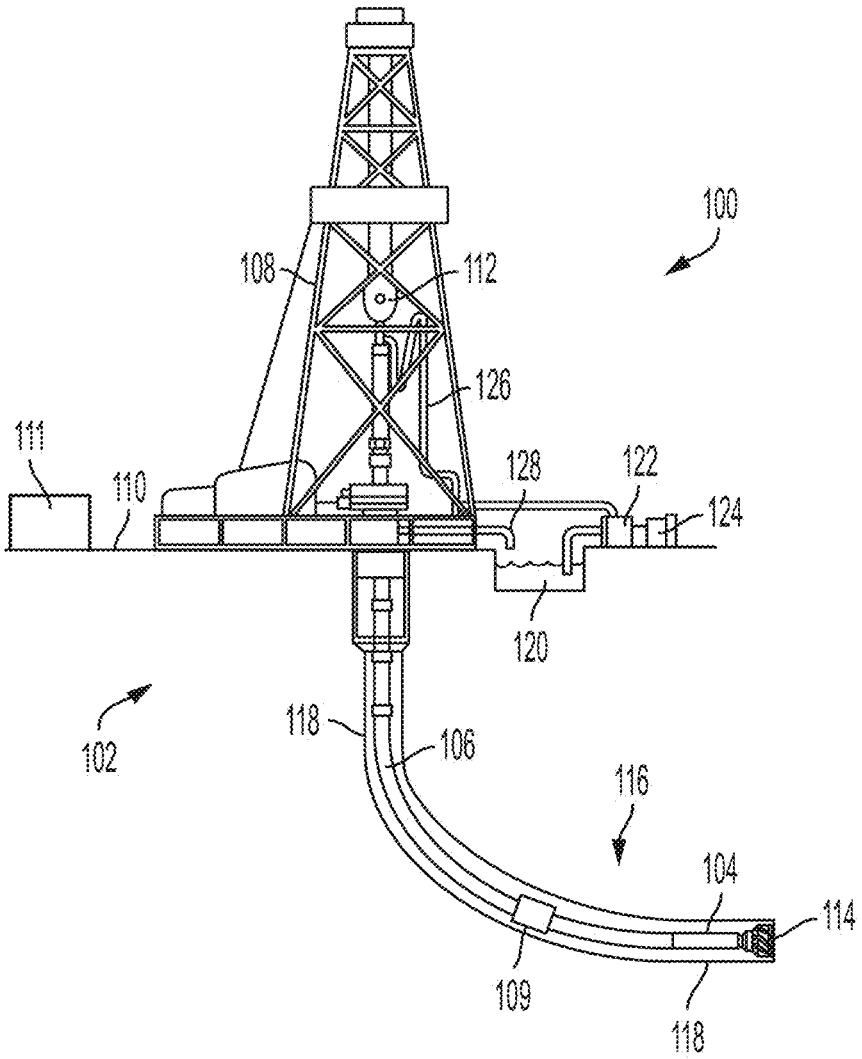
FIG. 1 is a cross-sectional view of a wellbore drilling system for determining a laminar-turbulent transition region of a fluid according to one example of the present disclosure.

Certain aspects and examples of the present disclosure relate to determining a laminar-turbulent transition of a fluid for use in downhole operations, such as drilling operations, in a wellbore. The laminar-turbulent transition region may be a transition state for the fluid wherein the fluid transitions from a laminar state to a turbulent state, or vice versa. The laminar-turbulent transition region may be used for modeling or simulating a wellbore hydraulic model for improving the efficiency of drilling operations in the wellbore. In some examples, the fluid can be received by a measurement tool that may recreate multiple wellbore conditions. The wellbore conditions can include a wellbore pressure, a friction factor, a relative pipe roughness, a viscosity of the fluid, a density of the fluid, and a flow rate of the fluid. The measurement tool may recreate wellbore conditions for the fluid within the measurement tool. By adjusting the fluid conditions, the measurement tool can cause the fluid to transition from a laminar state to a turbulent state to determine the laminar-turbulent transition region. Similarly, the measurement tool can adjust fluid conditions to cause the fluid to transition from the turbulent state to the laminar state to determine the laminar-turbulent transition region. The laminar-turbulent transition region of the fluid can be outputted for simulating or modeling the wellbore hydraulic system for adjusting drilling operations in the wellbore.

Managing wellbore pressure can be a function of wellbore drilling fluid and other fluids. The wellbore pressure may be managed by managing the flow rate, viscosity, and density of a drilling fluid or other fluids. Complications in managing the wellbore pressure can arise because of unknown wellbore conditions in the downhole during wellbore operations. Unknown wellbore conditions may cause difficulties in determining the laminar-turbulent transition region for the fluids. For example, the temperature of the drilling fluid can change throughout the wellbore based on the duration of downhole operations, the flow rate of the drilling fluid, formation thermal properties such as thermal diffusivity and thermal gradient, drilling fluid properties such as density and viscosity, and wellbore geometry such as the diameter and eccentricity of pipes, casing, and cement.

In some examples, friction reducers may be added to the fluid to reduce friction. Adding friction reducers to the fluid may change the laminar-turbulent transition region of the fluid. Additionally, the effectiveness of friction reducers may change during downhole operations, further increasing the difficulty in determining the laminar-turbulent transition region. Other factors affecting the fluid viscosity, such as emulsifiers, thinners, and the oil-to-water ratio of the fluid may affect the laminar-turbulent transition region. Additionally, long chain polymers within the fluid may degrade in the extreme thermal and shear conditions that can occur downhole, which may impact the laminar-to-turbulent transition region of the fluid. In some examples, the laminar-turbulent transition region of a fluid can be affected due to the fluid being a suspension. Suspensions may include particles ranging in size from a few microns in diameter to several thousand microns in diameter. These particles can have particle-to-particle interactions and interactions with the boundary layer that can change the laminar-turbulent transition region during wellbore drilling operations.

Managing wellbore pressure properly through using accurately determined laminar-turbulent transition regions may decrease non-productive time, reduce lost circulation, and may reduce potentially dangerous rig conditions. When modeling the wellbore hydraulics system, the laminar-turbulent transition region for the fluid may be critical for determining accurate simulations. Moreover, an accurate laminar-turbulent transition region in a wellbore hydraulics system model can also provide optimum operating conditions during a wellbore drilling operation. To determine an accurate laminar-turbulent transition region for use in simulating a wellbore hydraulics system or for use in downhole operations, fluid can be sampled and placed within a measurement tool. The measurement tool may recreate downhole wellbore conditions for the fluid within the measurement tool. By adjusting the conditions within the measurement tool to cause the fluid to change between the laminar state and the turbulent state, a laminar-turbulent transition region of the fluid can be determined. The laminar-turbulent transition region can be used in adjusting drilling operations downhole.

For example, drilling parameters for drilling operations such as weight-on-bit (WOB) and rate-of-penetration (ROP) can be adjusted based on the laminar-turbulent transition region to improve drilling operations. Adjusting the WOB and ROP may aid in controlling the wellbore pressure and can increase the efficiency of the drilling bit. Additionally, the laminar-turbulent transition region may be used to determine an addition of remedial materials to the fluid. For example, if the laminar-turbulent transition region is too high, energy loss can be minimized through the addition of friction flow reducers. In another example, remedial materials can be added to drilling fluid to adjust the laminar-turbulent transition region to change characteristics of the fluid such as fluid density, fluid rate, and flow viscosity. The remedial materials can include solid or wet lubricants, viscosifiers or thinners, wetting agents, weighing materials, lost-circulation materials (LCMs), or any other material that may lower the effects of contact stresses of tools in the wellbore.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a wellbore drilling system 100 for determining a laminar-turbulent transition region of a fluid according to one example of the present disclosure. A wellbore used to extract hydrocarbons may be created by drilling into a subterranean formation 102 using the drilling system 100. The drilling system 100 may include a bottom hole assembly (BHA) 104 positioned or otherwise arranged at the bottom of a drill string 106 extended into the subterranean formation 102 from a derrick 108 arranged at the surface 110. The derrick 108 includes a kelly 112 used to lower and raise the drill string 106. The BHA 104 may include a drill bit 114 operatively coupled to a tool string 116, which may be moved axially within a drilled wellbore 118 as attached to the drill string 106. Tool string 116 may include one or more sensors, for determining conditions in the wellbore. In some examples, sensors 109 may be positioned on drilling equipment and may sense formation properties or other types of properties about the drilling process, such as wellbore conditions. The sensors 109 can send signals to the surface 110 via a wired or wireless connection, and the sensors 109 may send real-time data relating to the drilling operation, formation, and wellbore conditions to the surface 110. The combination of any support structure (in this example, derrick 108), any motors, electrical equipment, and support for the drill string and tool string may be referred to herein as a drilling arrangement.

During operation, the drill bit 114 penetrates the subterranean formation 102 to create the wellbore 118. The BHA 104 can provide control of the drill bit 114 as it advances into the subterranean formation 102. The combination of the BHA 104 and drill bit 114 can be referred to as a drilling tool. Fluid or "drilling mud" from a mud tank 120 may be pumped downhole using a mud pump 122 powered by an adjacent power source, such as a prime mover or motor 124. The drilling mud may be pumped from the mud tank 120, through a stand pipe 126, which feeds the drilling mud into the drill string 106 and conveys the same to the drill bit 114. The drilling mud exits one or more nozzles (not shown) arranged in the drill bit 114 and in the process cools the drill bit 114. After exiting the drill bit 114, the drilling mud circulates back to the surface 110 via the annulus defined between the wellbore 118 and the drill string 106, and hole cleaning can occur which involves returning the drill cuttings and debris to the surface. The cuttings and mud mixture are passed through a flow line 128 and are processed such that a cleaned mud is returned down hole through the stand pipe 126 once again. In some examples, a sample of drilling mud may be used in a measurement tool 111 for determining a laminar-turbulent transition region of the drilling mud. In some examples, the measurement tool 111 may be positioned on the surface 110 of the wellbore 118. In other examples, the measurement tool 111 may be located outside of the drilling system 100, such as in a laboratory environment.

Although the measurement tool 111 is depicted in a drilling environment with drilling mud, in some examples, the measurement tool 111 may be used in other contexts and with other types of fluids, such as fracturing fluids in fracturing environments or cementing fluids in completion environments.

Figure 2:
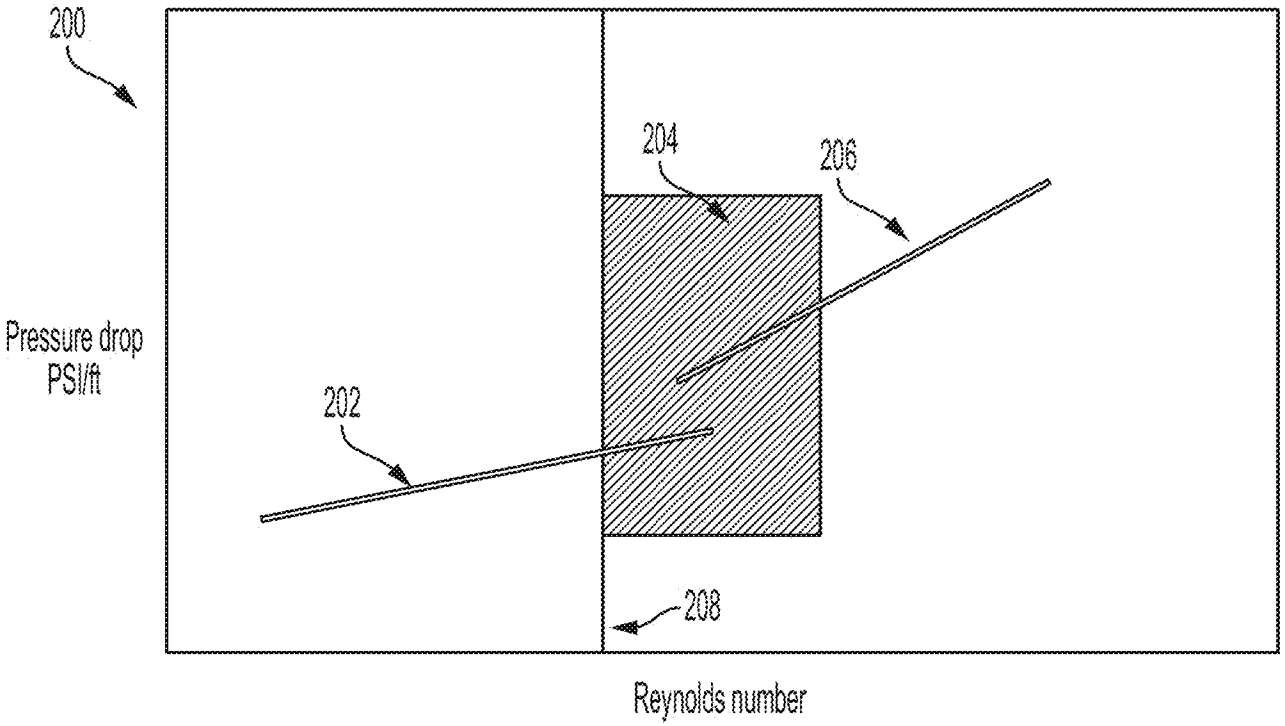
FIG. 2 is a graph depicting a laminar-turbulent transition region of a fluid according to one example of the present disclosure.

FIG. 2 is a graph 200 depicting a laminar-turbulent transition region of a fluid according to one example of the present disclosure. The X-axis of the graph 200 depicts Reynolds numbers for the fluid and the Y-axis depicts pressure drops of the fluid in pounds per square inch (PSI) per feet. In some examples, the Reynolds number can be used in determining fluid flow patterns. In fluid mechanics, Reynolds numbers can be a crucial dimensionless variable. At low Reynolds numbers, the fluid can be in a laminar state, whereas at high Reynolds numbers, the fluid can be in a turbulent state. For example, the fluid may remain in the laminar state 202 at low Reynolds numbers and low pressure drops. As the Reynolds numbers and pressure drops increase, the fluid may enter the laminar-turbulent transition region 204 with mixed laminar flows and turbulent flow. Line 208 depicts the starting Reynolds number for the laminar-turbulent transition region 204. The fluid can be very unstable in the laminar-turbulent transition region 204. The fluid may enter a turbulent state 206 as the pressure drops and Reynolds numbers further increase.

Figure 3:
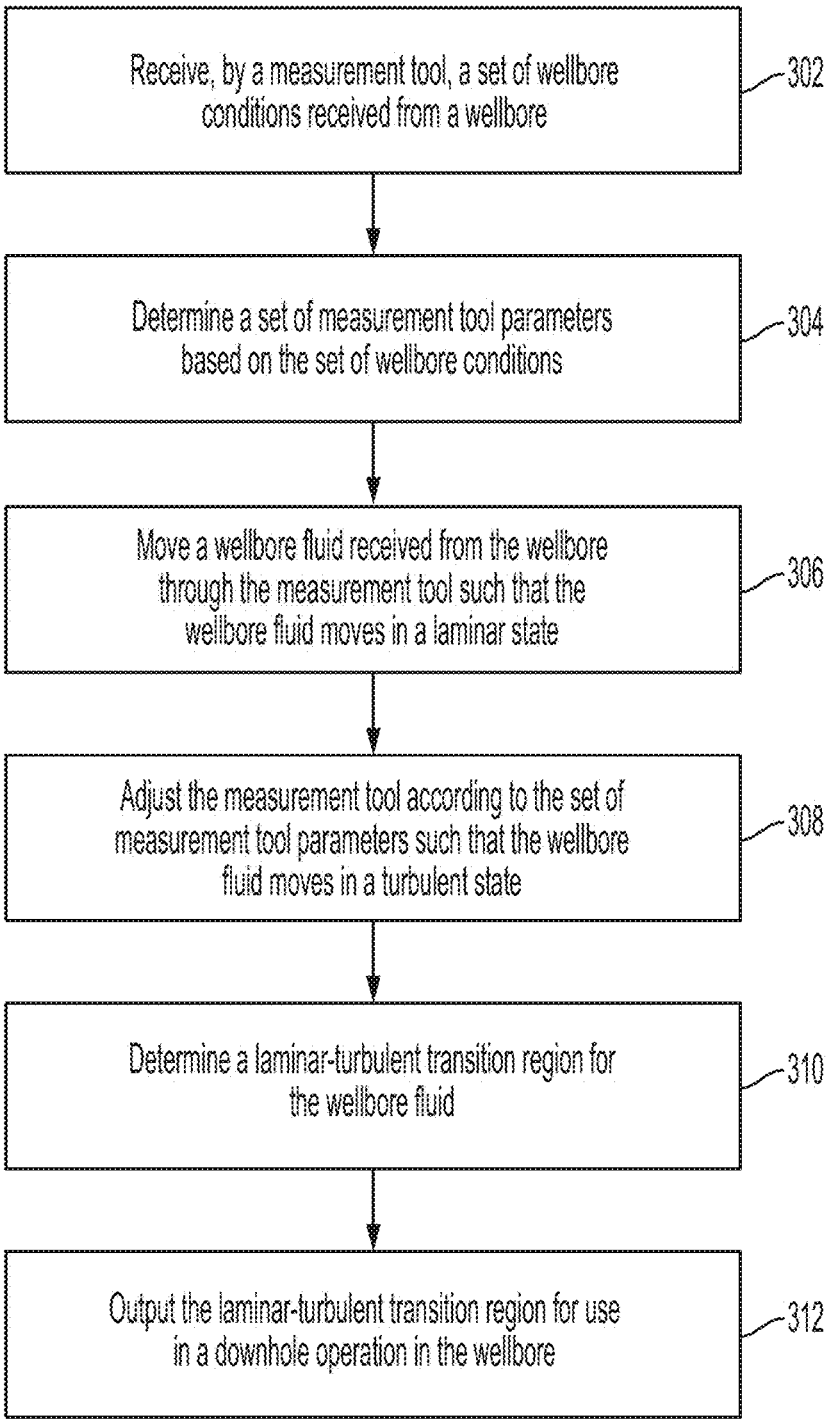
FIG. 3 is a flowchart of a process for determining a laminar-turbulent transition region of a fluid according to one example of the present disclosure.

FIG. 3 is a flowchart of a process for determining a laminar-turbulent transition region according to one example of the present disclosure. At block 302, the measurement tool 111 may receive a set of wellbore conditions from a wellbore 118. In some examples, the set of wellbore conditions may be received from sensors 109 positioned downhole in the wellbore 118. In some example, the set of wellbore conditions can include a wellbore temperature, a wellbore pressure, a friction factor, a relative pipe roughness, a viscosity of the fluid, a density of the fluid, and a flow rate of the fluid. In some examples, the wellbore temperature and the wellbore pressure can include ranges of temperatures and pressures. The ranges of temperatures and pressures may be determined based on the set of wellbore conditions.

At block 304, a set of measurement tool parameters can be determined based on the set of wellbore conditions. For example, the wellbore temperature and wellbore pressure can be used to determine a range of temperature and pressure settings for the measurement tool to provide for the fluid. Additionally or alternatively, the flow rate of the fluid may be used to determine a range of flow rate settings for the measurement tool to provide for the fluid. Other measurement tool parameters may be used to model various wellbore conditions as well. For example, additives may be added to the fluid to simulate certain densities or viscosities of fluid in the wellbore.

At block 306, the measurement tool 111 can move a fluid received from the wellbore 118 through the measurement tool 111. The measurement tool 111 can be set according to set of measurement tool parameters such that the fluid moves in a laminar state. For example, the measurement tool 111 can set the temperature and pressure for the fluid within the measurement tool to a first temperature and a first pressure from a range of determined temperatures and pressures. In some examples, the measurement tool may set the flow rate of the fluid to be a first flow rate of a range of flow rates. The first flow rate may cause the fluid to flow in a laminar state.

At block 308, the measurement tool 111 can adjust the measurement tool 111 according to the set of measurement tool parameters such that the fluid moves in a turbulent state. For example, the measurement tool 111 can increase the flow rate of the fluid to a next flow rate of the range of flow rates while the fluid is in the laminar state. In some examples, the measurement tool may determine a pressure drop and Reynolds number of the fluid flowing at the current flow rate. The measurement tool may continue to increase the flow rate of the fluid until the pressure drop and Reynolds number for each flow rate of the range of flow rates has been determined.

Additionally, after the measurement tool has increased the flow rate for the fluid for each flow rate of the range of flow rates, the measurement tool may increase the pressure and the temperature within the measurement tool to the next pressure and temperature of the ranges of pressures and temperatures. For each increased pressure and temperature, the measurement tool may cause the fluid to move at each flow rate of the range of flow rates as described above.

At block 310, the measurement tool 111 can determine a laminar-turbulent transition region for the fluid. For example, the measurement tool 111 can determine that the fluid has transitioned between the laminar state and the turbulent state based on the pressure drops and the Reynolds numbers determined while adjusting conditions such as the flow rate, pressure, and temperature. The laminar-turbulent transition region may include the Reynolds number ranges and pressure drop ranges where the fluid was between a laminar state and a turbulent state.

At block 312, the measurement tool 111 can output the laminar-turbulent transition region for use in a downhole operation in the wellbore. For example, the laminar-turbulent transition region may be incorporated into a wellbore simulation. The wellbore simulation may use the laminar-turbulent transition region to simulate wellbore conditions, such as pressure or temperature conditions. The simulated wellbore conditions can be used to determine adjustments to downhole operation parameters. For example, the wellbore simulation may predict a pressure drop in the wellbore based on the laminar-turbulent transition region. Drilling parameters, such as the flow rate, viscosity, and density of drilling fluids, may be adjusted to mitigate the effects of the pressure drop. Additionally or alternatively, the laminar-turbulent transition region may be output for use in other downhole operations, such as various drilling operations.

Figure 4:
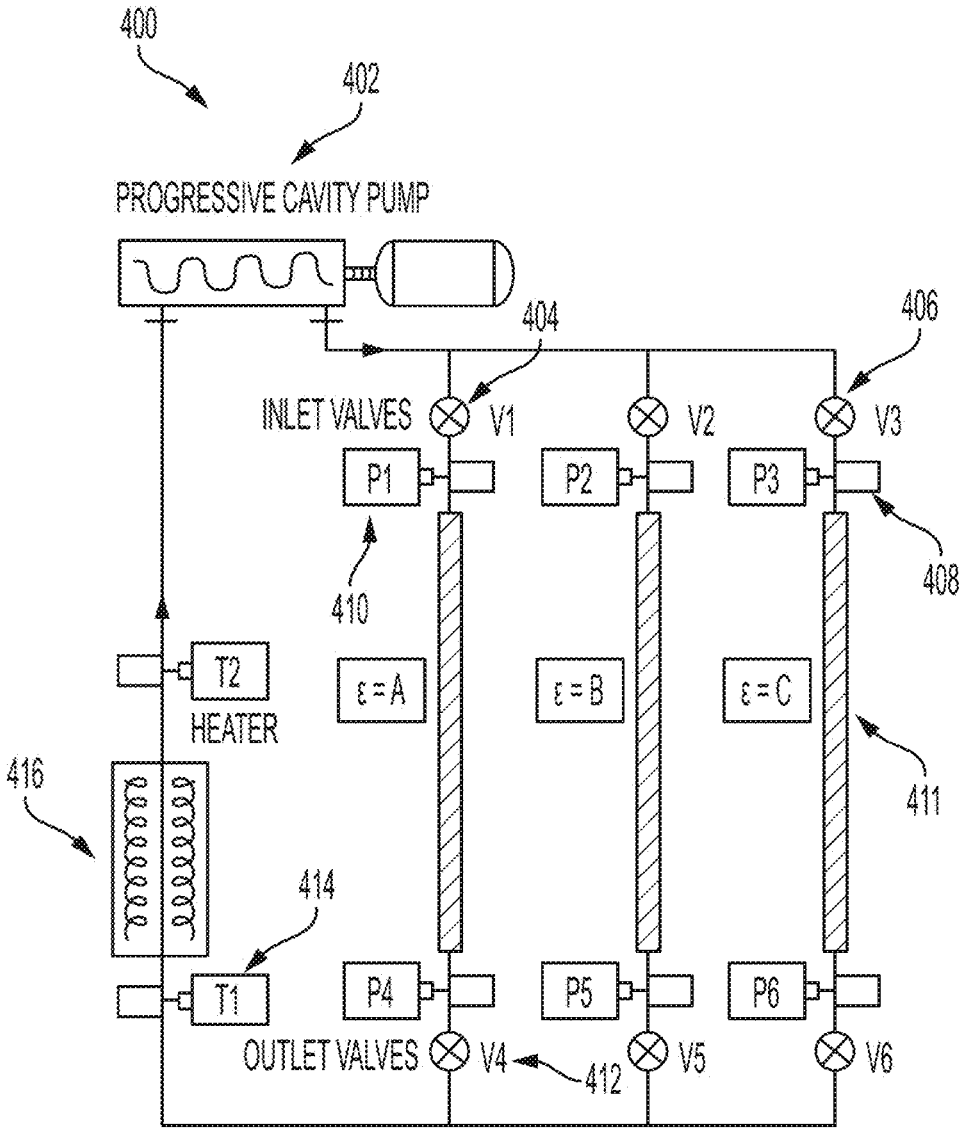
FIG. 4 is a measurement tool for determining a laminar-turbulent transition region of a fluid according to one example of the present disclosure.

FIG. 4 is a measurement tool 400 for determining a laminar-turbulent transition region of a fluid according to one example of the present disclosure. The measurement tool 111 can include a pump 402, inlet valves 406, flow straighteners 408, outlet valves 412, pressure sensors 410, annuli 411, thermometers 414, and a heater 416. In some examples, the pump 402 may be a progressive cavity pump. The pump 402 may pump the fluid through the measurement tool 400 to the inlet valves 406. The inlet valves 406 and outlet valves 412 may control the flow of the fluid and a pressure of the fluid through the annuli 411. The pressure sensors 410 positioned proximate an entrance and an exit of each annulus 411 may measure the pressure of the fluid before entering and after exiting the annuli 411 to determine the pressure drop across the annuli 411. Additionally, the flow straighteners 408 proximate the entrance and exit of each annulus 411 may adjust the flow rate of the fluid before entering and after exiting the annuli 411. In some examples, the annuli 411 may be concentric annuli or eccentric annuli, with varying degrees of eccentricity. The different eccentricities may be used to model the transition for annuli in wells that are horizontal or near horizontal. The heater 416 may heat the fluid to a particular temperature, and the thermometers 414 may be positioned proximate an entrance and exit of the heater 416 to measure the temperature of the fluid before entering and after exiting the heater 416.

In some examples, the measurement tool 400 may determine the laminar-turbulent transition region of the fluid in the manner described above in FIG. 3. For example, the pump 402 may pump the fluid through the annuli 411 in various temperatures and pressures from a range of temperatures and pressures. The temperature may be controlled by the heater 416 and the pressure may be controlled by the inlet valves 404. For each temperature and pressure, the pump 402 may pump the fluid through the annuli 411 in various flow rates from a range of flow rates. The flow rates may be controlled by the flow straighteners 408. In some examples, for each flow rate, the measurement tool 400 may determine a pressure drop and a Reynolds number for the fluid for use in determining a laminar-turbulent transition region. The measurement tool 400 may additionally include further components for recreating conditions according to the set of received wellbore conditions. In some examples, additives such as friction flow reducers may be added to the fluid to determine a change to the laminar-turbulent transition region.

Figure 5:
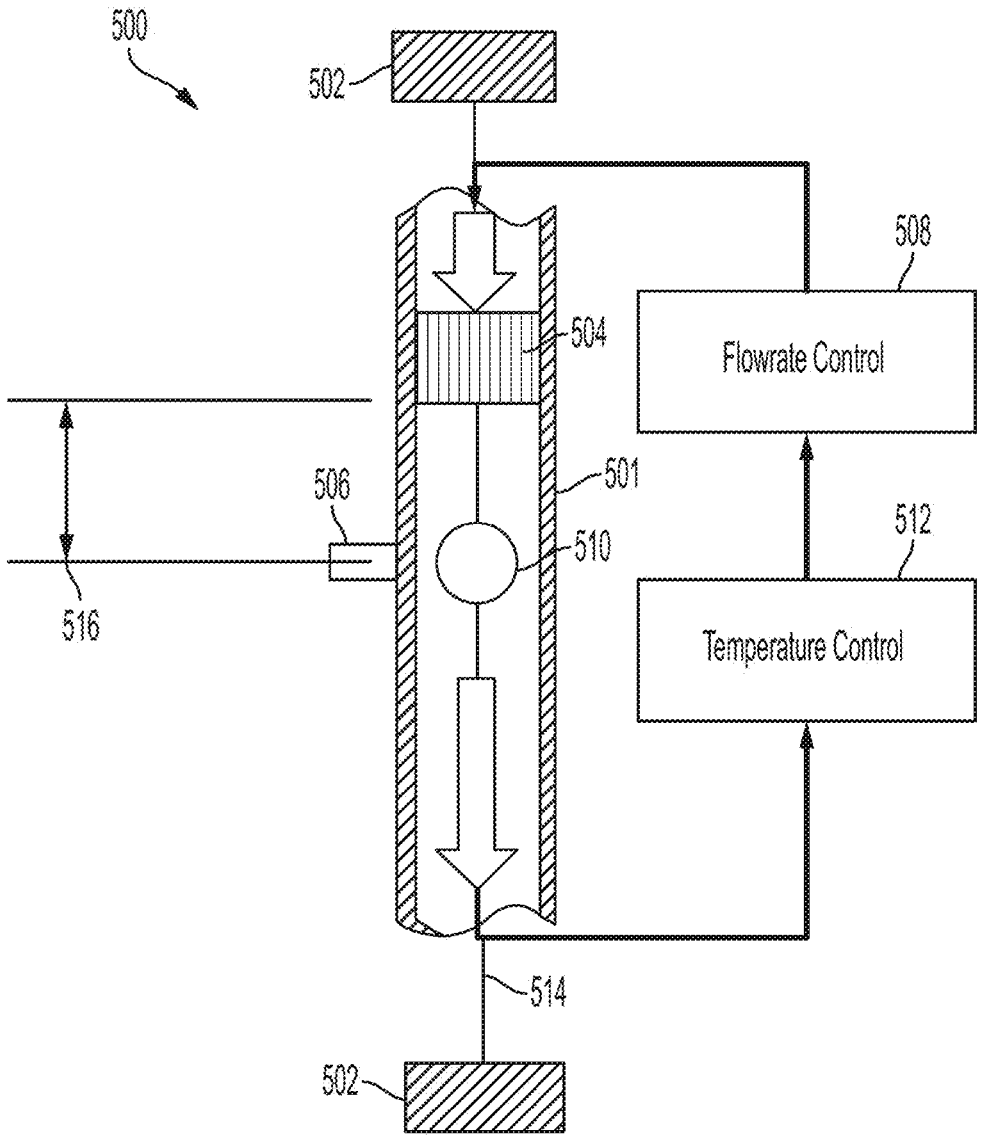
FIG. 5 is a diagram of another measurement tool for determining a laminar-turbulent transition region according to one example of the present disclosure.

FIG. 5 is a diagram of another measurement tool 500 for determining a laminar-turbulent transition region of a fluid according to one example of the present disclosure. The measurement tool 500 can include a tubular structure 501 with an inner surface defining a flow path for a fluid. A wire 514 may be strung through the tubular structure 501 and may be supported by supports 502. A ball 510 may be suspended on the wire 514 within the tubular structure 501. In some examples, the suspension of the wire 514 suspending the ball 510 may be adjusted to model different eccentricities of an annulus in the wellbore. The measurement tool 500 can also include a flow rate control 508 for controlling a flow of the fluid through the tubular structure 501, and a temperature control 512 for controlling a temperature of the fluid in the tubular structure 501. In some examples, the measurement tool 500 may additionally include a pressure control for controlling a pressure of the fluid in the tubular structure 501. A sensor 506 may be positioned proximate the ball 510 for measuring a motion of the ball 510.

In some examples, the measurement tool 500 may determine the laminar-turbulent transition region of the fluid in the manner described above in FIG. 3. For example, the flow rate control 508 may control the flow of the fluid through the measurement tool 500. In some examples, the fluid may first flow through a flow straightener before entering the tubular structure 501. After reaching a sufficient distance 516 from an entrance 504 of the tubular structure 501, the fluid may have a stable and laminar flow. In some examples, the distance 516 may be a length equal to 20 times the diameter of the tubular structure 501. The temperature and pressure of the fluid may be controller by the temperature control 512 and the pressure control of the measurement tool 500. The measurement tool 500 may cause the fluid to flow through the tubular structure 501 in various temperatures and pressures from a range of temperatures and pressures. For each temperature and pressure, the flow rate control 508 can control the flow of the fluid through the tubular structure 501 at various flow rates from a range of flow rates.

In some examples, for each flow rate, the sensor 506 may detect a motion of the ball 510 in the flow of the fluid. The sensor 506 can detect a position of the ball 510 relative to its initial position in the tubular structure 501. The sensor 506 can also detect an intensity of the motion of the ball 510. As the flow rate is incrementally increased or incrementally decreased, the motion of the ball 510 and the intensity of the motion may increase in reaction to turbulence in the flow. The sensor 506 can calculate a Reynolds number for each flow rate using the motion of the ball 510 and the intensity of the motion. The Reynolds number may be used to determine the laminar-turbulent transition region of the fluid. In some examples where the fluid is a fracturing fluid, additives such as friction flow reducers may be added to the wellbore to determine a change to the laminar-turbulent transition region.

In some aspects, method and apparatus for determining a laminar-turbulent transition region of fluid are provided according to one or more of the following examples:

Example #1

A method can include receiving, by a measurement tool, a plurality of wellbore conditions from a wellbore; determining a plurality of measurement tool parameters based on the plurality of wellbore conditions; moving a fluid received from the wellbore through the measurement tool that is configured according to the plurality of measurement tool parameters such that the fluid moves in a laminar state; adjusting, by the measurement tool, the measurement tool according to the plurality of measurement tool parameters such that the fluid moves in a turbulent state; determining, by the measurement tool, a laminar-turbulent transition region for the fluid; and outputting the laminar-turbulent transition region for use in a drilling operation in the wellbore.

Example #2

The method of Example #1 can feature the plurality of wellbore conditions including a wellbore temperature, a wellbore pressure, a friction factor, a relative pipe roughness, a viscosity of the fluid, a density of the fluid, and a flow rate of the fluid.

Example #3

The method of any of Examples #1-2 can include determining the laminar-turbulent transition region by determining that the fluid has transitioned between the laminar state and the turbulent state.

Example #4

The method of any of Examples #1-3 can feature adjusting the measurement tool by increasing the flow rate of the fluid.

Example #5

The method of any of Examples #1-4 can feature the plurality of measurement tool parameters including a pressure range, a temperature range, and a flow rate range.

Example #6

The method of any of Examples #1-5 may include adjusting the measurement tool by adjusting, by a heater in the measurement tool, a temperature of the temperature range for the fluid; and adjusting, by a valve in the measurement tool, a pressure of the pressure range for the fluid.

Example #7

The method of any of Examples #1-6 may include outputting the laminar-turbulent transition region for use in a drilling operation by incorporating the laminar-turbulent transition region into a simulation of the wellbore; determining, using the simulation of the wellbore, simulated wellbore conditions in the wellbore; and determining, using the simulated wellbore conditions, adjustments to the flow rate of the fluid, the viscosity of the fluid, and the density of the fluid for drilling operations in the wellbore.

Example #8

A measurement tool can include a pump configured to receive a fluid and to pump the fluid throughout the measurement tool at a particular flow rate corresponding to a laminar state or a turbulent state; a heater configured to heat the fluid according to a wellbore parameter; and a plurality of pressure valves positionable proximate an entrance and an exit of an annulus within the measurement tool, the plurality of pressure valves being configured to measure a pressure of the fluid and to determine a laminar-turbulent transition region for use in adjusting a drilling operation based on a difference in pressure between the entrance and the exit of the annulus.

Example #9

The measurement tool of Example #8 can feature the pump being a progressive cavity pump configured to provide a constant flow of fluid within the measurement tool.

Example #10

The measurement tool of any of Examples #8-9 can include a plurality of thermometers positionable proximate an entrance and an exit of the heater, the plurality of thermometers being configurable to measure a temperature of the fluid before and after the fluid moves through the heater.

Example #11

The measurement tool of any of Examples #8-10 can include the annulus being a concentric annulus or an eccentric annulus.

Example #12

The measurement tool of any of Examples #8-11 can include a plurality of flow straighteners positionable proximate each valve of the plurality of pressure valves, the plurality of flow straighteners being configurable to adjust the particular flow rate.

Example #13

A measurement tool can include a tubular structure with an inner surface defining a flow path for a fluid, the tubular structure configured to cause the fluid to flow through the tubular structure in a laminar state or a turbulent state; a ball positionable to be suspended on a wire within the tubular structure; and a sensor positionable proximate the ball for measuring a motion of the ball, wherein the sensor is configured to determine a laminar-turbulent transition region for the fluid for use in adjusting a drilling operation based on the motion of the ball.

Example #14

The measurement tool of Example #13 can be configured according to a plurality of wellbore conditions, wherein the plurality of wellbore conditions comprises a friction factor, a relative pipe roughness, a viscosity of the fluid, a density of the fluid, and a flow rate.

Example #15

The measurement tool of any of Examples #13-14 can include a flow rate control configured to control a flow rate of the fluid through the tubular structure; and a temperature control configured to control a temperature of the fluid flowing through the tubular structure.

Example #16

The measurement tool of any of Examples #13-15 may feature a suspension of the wire being adjustable to model an eccentricity of an annulus downhole in a wellbore.

Example #17

The measurement tool of any of Examples #13-16 may feature the sensor being configured to detect an intensity of the motion of the ball, and wherein the motion and the intensity are usable for determining a Reynolds number as indication of a fluid state.

Example #18

The measurement tool of any of Examples #13-17 may feature the fluid being in the laminar state, and wherein the flow rate control is configured to incrementally increase the flow rate of the fluid until the motion of the ball indicates the fluid is in the laminar-turbulent transition region.

Example #19

The measurement tool of any of Examples #13-18 may feature the fluid being in the turbulent state, and wherein the flow rate control is configured to incrementally decrease the flow rate of the fluid until the motion of the ball indicates the fluid is in the laminar-turbulent transition region.

Example #20

The measurement tool of any of Examples #13-19 may feature the fluid being a fracturing fluid receivable to include a friction flow reducer, and wherein the sensor is configured to detect the motion of the ball for use in determining the laminar-turbulent transition region for the fracturing fluid.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A measurement tool comprising:

a tubular structure with an inner surface defining a flow path for a fluid, the tubular structure configured to cause the fluid to flow through the tubular structure in a laminar state or a turbulent state;

a ball positionable to be suspended on a wire within the tubular structure; and a sensor positionable proximate the ball for measuring a motion of the ball, wherein the sensor is configured to determine a laminar-turbulent transition region for the fluid for use in adjusting a drilling operation based on the motion of the ball.

2. The measurement tool of claim 1, wherein the measurement tool is configured according to a plurality of wellbore conditions, wherein the plurality of wellbore conditions comprises a friction factor, a relative pipe roughness, a viscosity of the fluid, a density of the fluid, and a flow rate.

3. The measurement tool of claim 1, further comprising:

a flow rate control configured to control a flow rate of the fluid through the tubular structure; and a temperature control configured to control a temperature of the fluid flowing through the tubular structure.

4. The measurement tool of claim 3, wherein a suspension of the wire is adjustable to model an eccentricity of an annulus downhole in a wellbore.

5. The measurement tool of claim 3, wherein the sensor is configured to detect an intensity of the motion of the ball, and wherein the motion and the intensity are usable for determining a Reynolds number as indication of a fluid state.

6. The measurement tool of claim 5, wherein the fluid is in the laminar state, and wherein the flow rate control is configured to incrementally increase the flow rate of the fluid until the motion of the ball indicates the fluid is in the laminar-turbulent transition region.

7. The measurement tool of claim 5, wherein the fluid is in the turbulent state, and wherein the flow rate control is configured to incrementally decrease the flow rate of the fluid until the motion of the ball indicates the fluid is in the laminar-turbulent transition region.

8. The measurement tool of claim 1, wherein the fluid is a fracturing fluid receivable to include a friction flow reducer, and wherein the sensor is configured to detect the motion of the ball for use in determining the laminar-turbulent transition region for the fracturing fluid.

* * * * *